US008426095B2

(12) United States Patent
Aoki et al.

(10) Patent No.: US 8,426,095 B2
(45) Date of Patent: Apr. 23, 2013

(54) TONER

(75) Inventors: Takayasu Aoki, Shizuoka-ken (JP); Junichi Ishikawa, Shizuoka-ken (JP); Tsuyoshi Itou, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 137 days.

(21) Appl. No.: 12/978,771

(22) Filed: Dec. 27, 2010

(65) Prior Publication Data

US 2011/0165509 A1 Jul. 7, 2011

Related U.S. Application Data

(60) Provisional application No. 61/292,044, filed on Jan. 4, 2010, provisional application No. 61/299,108, filed on Jan. 28, 2010.

(51) Int. Cl.
*G03G 9/093* (2006.01)

(52) U.S. Cl.
USPC ..... 430/108.1; 430/110.1; 430/110.2; 430/110.4

(58) Field of Classification Search ..... 430/108.1, 430/110.1, 110.2, 110.4
See application file for complete search history.

(56) References Cited

U.S. PATENT DOCUMENTS

| | | | | |
|---|---|---|---|---|
| 6,203,603 | B1 * | 3/2001 | Takayama et al. | 106/31.16 |
| 2008/0233508 | A1 * | 9/2008 | Kamiyoshi et al. | 430/110.3 |
| 2010/0209839 | A1 | 8/2010 | Kabai et al. | |

FOREIGN PATENT DOCUMENTS

| | | |
|---|---|---|
| EP | 0980028 A1 | 2/2000 |
| EP | 2219081 A2 | 8/2010 |

OTHER PUBLICATIONS

Extended European Search Report for Application No. 10197037.4-1217 dated Apr. 20, 2011.

* cited by examiner

*Primary Examiner* — Hoa V Le
(74) *Attorney, Agent, or Firm* — Turocy & Watson, LLP

(57) ABSTRACT

Disclosed is a decolorable toner containing a binder resin and a coloring agent which contains a color former compound and a color developing agent and has a capsule structure such that it is covered with an outer shell, and having a volume average particle diameter of from 5.0 to 15.0 μm and a number-based particle size distribution CV of 35% or less.

12 Claims, 3 Drawing Sheets

FIG.3

| | Example 1 | Example 2 | Example 3 | Example 4 | Example 5 | Example 6 | Example 7 | Example 8 | Comparative example 1 | Comparative example 2 | Comparative example 3 |
|---|---|---|---|---|---|---|---|---|---|---|---|
| Volume average particle diameter of toner (μm) | 10.3 | 7.5 | 11.4 | 5.0 | 15.0 | 8.3 | 9.5 | 9.8 | 4.5 | 16.2 | 10.5 |
| Average particle diameter of coloring agent (μm) | 2.9 | 2.9 | 2.9 | 2.9 | 2.9 | 2.9 | 2.9 | 2.9 | 2.9 | 2.9 | 2.9 |
| Ratio of particle diameter of coloring agent to particle diameter of toner | 0.28 | 0.39 | 0.25 | 0.58 | 0.19 | 0.35 | 0.31 | 0.30 | 0.69 | 0.19 | 0.39 |
| Particle size distribution CV (%) | 27 | 31 | 29 | 32 | 34 | 35 | 35 | 32 | 30 | 25 | 45 |
| Average circularity | 0.942 | 0.954 | 0.970 | 0.921 | 0.950 | 0.963 | 0.985 | 0.931 | 0.830 | 0.930 | 0.870 |
| Image density when color is developed | 0.52 | 0.55 | 051 | 0.42 | 0.45 | 0.45 | 0.46 | 0.45 | 0.35 | 0.45 | 0.41 |
| Image density when color is erased | 0.08 | 0.07 | 0.08 | 0.07 | 0.07 | 0.10 | 0.09 | 0.10 | 0.10 | 0.07 | 0.08 |
| Charging stability | A | A | AA | B | B | B | A | A | C | C | C |
| Toner scattering | A | A | A | B | A | A | A | B | C | A | C |
| Transfer property | A | A | AA | B | A | A | A | B | C | A | C |

TONER

CROSS-REFERENCE TO RELATED APPLICATION

This application is also based upon and claims the benefit of priority from U.S. provisional application 61/292,044, filed on Jan. 4, 2010; and 61/299,108, filed on Jan. 28, 2010; the entire contents of which are incorporated herein by reference.

FIELD

Embodiments described herein relate generally to a technique for a decolorable toner which is used in developing an electrostatic image or a magnetic latent image in an electrophotographic process, an electrostatic printing process, or the like.

BACKGROUND

In an office information environment, due to the widespread use of computer, software, and network, it became possible to accelerate and share information processing. The digitization of information is excellent in terms of storage, accumulation, and retrieval of information, etc., however, a paper medium is superior in terms of display (particularly viewability) and transfer of information. Therefore, as digitization of information is proceeding, the amount of paper used is increasing. On the other hand, reduction of consumption energy typified by $CO_2$ emission is an urgent need in various fields. If a paper medium which is used for temporary display or transfer of information can be recycled, it can contribute much to the reduction of consumption energy.

Therefore, as a technique in which a paper medium can be recycled by erasing an image from the paper medium on which the image is output, a decolorable toner is proposed.

Examples of the decolorable toner include those produced by a pulverization method. However, a plurality of components such as a color former compound, a color developing agent, and a decolorizing agent are handled in a solid phase, and therefore coloring and decolorizing reactions are neither prompt nor sufficient in some cases.

DESCRIPTION OF THE DRAWINGS

FIG. 3 is a table showing the properties of toners of Examples.

DETAILED DESCRIPTION

Figure 1:
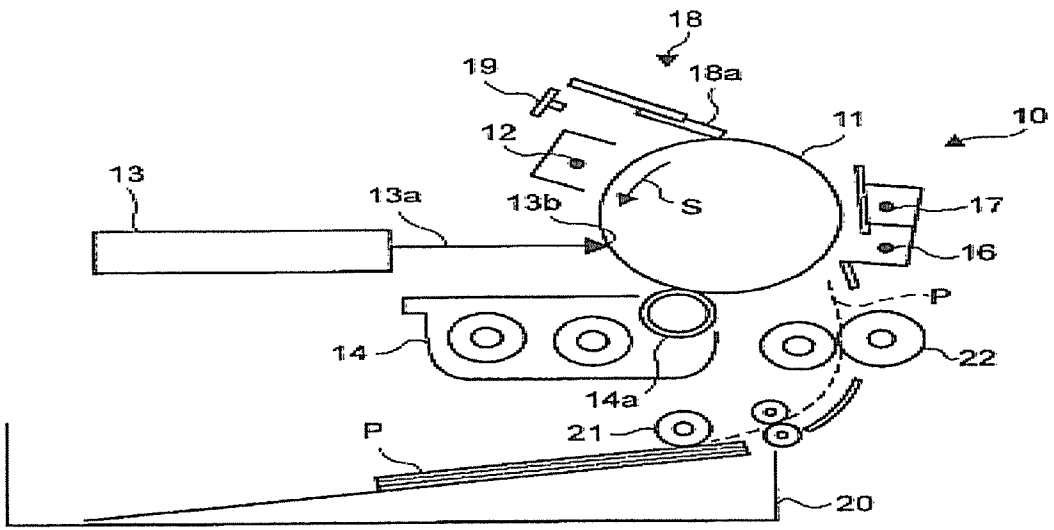
FIG. 1 is a schematic view showing an image forming section of an image forming apparatus in which a developer containing a toner according to an embodiment is placed.

Hereinafter, embodiments will be described with reference to the drawings.

The toner according to this embodiment contains a binder resin and a coloring agent which contains a color former compound and a color developing agent and has a capsule structure such that it is covered with an outer shell, and the toner has a volume average particle diameter of from 5.0 to 15.0 μm and a number-based particle size distribution CV of 35% or less. By performing a decolorizing treatment of the toner, an image output on a sheet using the toner by an electrophotographic process, an electrostatic printing process, or the like can be erased.

When an image is formed using a decolorable toner, a paper medium on which an image is formed can be reused by erasing the formed image by a decolorizing operation (hereinafter, the "paper medium" is referred to as "reused paper medium"). Here, the present inventors found that as the number of reused times is increased, the stability in a transferring step is decreased. When the stability in a transferring step is low, unevenness is caused in a formed image in some cases.

After a great deal of study, the present inventors found that as the number of reused times is increased, the amount of toner components on the paper is increased, and a resistance when transferring is increased, and therefore, the charging stability is liable to decrease and also the transfer efficiency tends to drop. That is, on the reused paper medium, the color imparted to the toner by the coloring agent is erased by a decolorizing operation, however, the toner components such as a binder resin and a wax remain on the paper even after the image is erased. The present inventors revealed the problem of the reused paper medium itself that as the amount of the toner components remaining on the paper is increased, the charging stability and the transfer efficiency are affected, and the stability in the transferring step is decreased.

Then, as a result of intensive study, the present inventors found that in a decolorable toner in which a coloring agent is encapsulated, by allowing the volume average particle diameter and the distribution thereof to fall within the above predetermined ranges, even if the reused paper medium is used as a paper medium, a toner having improved stability in the transferring step can be provided. Further, by allowing the volume average particle diameter and the distribution thereof to fall within the above predetermined ranges, the coloring property of the toner is also improved.

The "volume average particle diameter" as used herein refers to the particle diameter of a particle the value of which is arrived at when the cumulative volume distribution of the particles reaches 50% determined from the sum of the volumes of the individual particles calculated from the particle diameters (volume D50). The volume average particle diameter can be determined using, for example, Multisizer 3 (aperture diameter: 100 μm, manufactured by Beckman Coulter, Inc.). The volume average particle diameter can be obtained by measuring the particle diameters of, for example, 50000 particles.

According to this embodiment, the volume average particle diameter of the toner is 5.0 μm or more, preferably 7.5 μm or more. If the volume average particle diameter of the toner is less than 5.0 μm, since the coloring agent having a particle diameter on the order of several micrometers is contained in the toner, the coloring agent may not be uniformly contained in the toner having a small particle diameter, and therefore, an image density may be decreased. Further, the volume average particle diameter of the toner is 15 μm or less, preferably 13 μm or less. If the volume average particle diameter of the toner is more than 15 μm, in the case of a common electrophotographic process, the charging stability is low, and also the toner consumption amount is increased as compared with the case where the volume average particle diameter of the toner is 15 μm or less.

Further, the "particle size distribution CV (%)" as used herein refers to a value calculated from the following formula (1).

$$CV=(a/b)\times 100 \quad (1)$$

In the formula (1), CV represents a number-based particle size distribution (%), a represents a standard deviation of a number average particle diameter, and b represents a number average particle diameter (obtained by the measurement of, for example, 50000 particles). Incidentally, the number average particle diameter is an average of the diameters of fine particles measured. The number average particle diameter can also be determined using a particle diameter measuring device (such as Multisizer 3) in the same manner as the volume average particle diameter.

According to this embodiment, the particle size distribution CV (%) is 35% or less. By setting the particle size distribution CV (%) to 35% or less, coarse particles and fine powder components in the toner can be decreased, and the charging stability of the toner can be increased as compared with the case where the particle size distribution CV (%) is more than 35%. As a result, the stability in the developing and transferring steps can be improved.

Incidentally, the lower limit of the particle size distribution CV is not particularly limited, however, from the viewpoint of the controlling property of the particle size distribution in a production method through aggregation and fusion, it can be set to, for example 15%.

Further, the toner according to this embodiment is preferably has an average circularity of from 0.925 to 0.970.

The average circularity can be obtained by measurement using a flow-type particle image analyzer. The "flow-type particle image analyzer" is a device in which an image of each particle is taken as a two-dimensional image, and from the area of the two-dimensional image of each particle, the diameter of a circle having the same area is calculated as a circle-corresponding diameter. As the flow-type particle image analyzer, for example, FPIA-2100 manufactured by Sysmex Corporation can be exemplified.

Specifically, by using a flow-type particle image analyzer, for example, for particles having a circle-corresponding diameter of from 0.50 to 200 μm, the particle diameter of the circle-corresponding diameter is measured. Then, the circularity of the particle measured is calculated from the following formula (2). Further, for the particles having a circle-corresponding diameter of from 0.50 to 200 μm, the sum of the circularities is divided by the total number of the particles, and the obtained value is defined as an average circularity. The measurement was performed for 2000 to 4000 particles, and the average circularity is calculated.

$$y=x/z \quad (2)$$

In the formula (2), y represents a circularity, x represents the circumferential length of a circle having the same projected area as that of the image of a particle, and z represents the circumferential length of the projected image of the particle.

If the average circularity is less than 0.925, fusion is liable to be insufficient as compared with the case where the average circularity is 0.925 or more. As a result, when a stress is applied to the toner in a developing device, the toner is crushed to increase the amount of fine powder components in some cases. Meanwhile, if the average circularity is more than 0.970, problems arise that the cleaning property is poor, and so on as compared with the case where the average circularity is 0.970 or less.

In other words, by setting the average circularity of the decolorable toner according to this embodiment to 0.925 to 0.970, the stability in the transferring step can be further improved.

Subsequently, the constituent components of the toner according to this embodiment will be described.

The toner according to this embodiment contains a coloring agent and a binder resin. Incidentally, the "coloring agent" as used herein refers to one kind of compound or a composition that imparts a color to the toner.

As the binder resin to be used in the toner according to this embodiment, a polyester resin obtained by subjecting a dicarboxylic acid component and a diol component to an esterification reaction followed by polycondensation is preferably used. Examples of the acid component include aromatic dicarboxylic acids such as terephthalic acid, phthalic acid, and isophthalic acid; and aliphatic dicarboxylic acids such as fumaric acid, maleic acid, succinic acid, adipic acid, sebacic acid, glutaric acid, pimelic acid, oxalic acid, malonic acid, citraconic acid, and itaconic acid.

Examples of the diol component include aliphatic diols such as ethylene glycol, propylene glycol, 1,4-butanediol, 1,3-butanediol, 1,5-pentanediol, 1,6-hexanediol, neopentyl glycol, trimethylene glycol, trimethylolpropane, and pentaerythritol; alicyclic diols such as 1,4-cyclohexanediol and 1,4-cyclohexanedimethanol; and an ethylene oxide or propylene oxide adduct of bisphenol A or the like.

Further, the above polyester component may be converted so as to have a crosslinking structure using a trivalent or higher polyvalent carboxylic acid component or a trihydric or higher polyhydric alcohol component such as 1,2,4-benzenetricarboxylic acid (trimellitic acid) or glycerin.

Two or more kinds of polyester resins having different compositions may be mixed and used.

The polyester resin may be amorphous or crystalline.

The glass transition temperature of the polyester resin is preferably 45° C. or higher and 70° C. or lower, and more preferably 50° C. or higher and 65° C. or lower. If the glass transition temperature is lower than 45° C., the heat-resistant storage stability of the toner is deteriorated, and further a gloss derived from the resin when erasing is noticeable, and therefore it is not preferred. If it is higher than 70° C., the low-temperature fixability is deteriorated, and further, the erasing property when heating is poor, and therefore it is not preferred. The weight average molecular weight Mw of the polyester resin is preferably 5000 or more and 30000 or less, more preferably 7000 or more and 25000 or less. If it is 5000 or less, a gloss derived from the resin when erasing is noticeable, and therefore it is not preferred. Further, if it is 25000 or more, in general, the fixing temperature of the toner becomes higher than the decolorizing temperature of an image, and therefore it is not preferred.

According to this embodiment, the coloring agent contains a color former compound and a color developing agent.

Specifically, the coloring agent can be formed of an electron donating color former compound and an electron accepting color developing agent. As the electron donating color former compound, specifically, a leuco dye can be used. The leuco dye alone is colorless, however, a color is developed when the leuco dye and the color developing agent are bonded to each other.

Examples of the leuco dye include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples of the leuco dye include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino) fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino) fluoran, 1,2-benz-6-(N-ethyl-N-isoamylamino)fluoran, 2-(3-methoxy-4-dodecoxystyryl)quinoline, spiro[5H-(1) benzopyrano(2,3-d)pyrimidine-5,1'(3'H)isobenzofuran]-3'-one, 2-(diethylamino)-8-(diethylamino)-4-methyl-, spiro [5H-(1)benzopyrano(2,3-d)pyrimidine-5,1'(3'H) isobenzofuran]-3'-one, 2-(di-n-butylamino)-8-(di-n-butylamino)-4-methyl-, spiro[5H-(1)benzopyrano(2,3-d) pyrimidine-5,1'(3'H)isobenzofuran]-3'-one, 2-(di-n-butylamino)-8-(diethylamino)-4-methyl-, spiro[5H-(1) benzopyrano(2,3-d)pyrimidine-5,1'(3'H)isobenzofuran]-3'-one, 2-(di-n-butylamino)-8-(N-ethyl-N-1-amylamino)-4-methyl-, spiro[5H-(1)benzopyrano(2,3-d)pyrimidine-5,1' (3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Additional examples thereof include pyridine compounds, quinazoline compounds, and bisquinazoline compounds. These compounds may be used by mixing two or more of them.

The color developing agent for developing the color of the color former compound is an electron accepting compound which donates a proton to the leuco dye. Examples thereof include phenols, metal salts of phenols, metal salts of carboxylic acids, aromatic carboxylic acids, aliphatic carboxylic acids having 2 to 5 carbon atoms, benzophenones, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole, and derivatives thereof. Additional examples thereof include those having, as a substituent, an alkyl group, an aryl group, an acyl group, an alkoxycarbonyl group, a carboxy group or an ester thereof, an amide group, a halogen group, or the like, and bisphenols, trisphenols, phenol-aldehyde condensed resins, and metal salts thereof.

Specific examples thereof include phenol, o-cresol, tertiary butyl catechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acid or esters thereof such as methyl 2,3-dihydroxybenzoate and methyl 3,5-dihydroxybenzoate, resorcin, gallic acid, dodecyl gallate, ethyl gallate, butyl gallate, propyl gallate, 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl)propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)-n-hexane, 1,1-bis (4-hydroxyphenyl)-n-heptane, 1,1-bis(4-hydroxyphenyl)-n-octane, 1,1-bis(4-hydroxyphenyl)-n-nonane, 1,1-bis(4-hydroxyphenyl)-n-decane, 1,1-bis(4-hydroxyphenyl)-n-dodecane, 2,2-bis(4-hydroxyphenyl)butane, 2,2-bis(4-hydroxyphenyl)ethyl propionate, 2,2-bis(4-hydroxyphenyl)-4-methylpentane, 2,2-bis(4-hydroxyphenyl)hexafluoropropane, 2,2-bis(4-hydroxyphenyl)-n-heptane 2,2-bis(4-hydroxyphenyl)-n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzene triol, 4,4'-[1,4-phenylenebis(1-methylethylidene)bis(benzene-1,2,3-triol)], 4,4'-[1,4-phenylenebis (1-methylethylidene) bis(1,2-benzenediol)], 4,4',4"-ethylidenetrisphenol, 4,4'-(1-methylethylidene)bisphenol, and methylenetris-p-cresol. These compounds may be used by mixing two or more of them.

According to this embodiment, the coloring agent is encapsulated and has an outer shell formed of a shell material (encapsulating agent). As the shell material, a urethane resin or the like is used. By encapsulating the coloring agent, the color which is once erased can be prevented from being redeveloped due to the effect particularly of the acid value of the binder resin in the toner.

Further, in the encapsulated coloring agent, the leuco dye and the color developing agent may be present in a resin (temperature control agent) having a large temperature difference between the melting point and the solidifying point. In this case, when the temperature reaches the melting point of the temperature control agent by heating, the bond between the leuco dye and the color developing agent is cleaved, whereby the coloring agent is decolorized. Even if the coloring agent is cooled thereafter, since the solidifying point of the temperature control agent is not higher than normal temperature, a decolorized state is maintained.

Here, in the toner according to this embodiment, the volume average particle diameter of the coloring agent is 3.5 μm or less, and it is preferred to satisfy the relation: $m/n \leqq 0.5$, wherein m represents the volume average particle diameter of the coloring agent and n represents the volume average particle diameter of the toner. If the volume average particle diameter of the coloring agent is more than 3.5 μm, or if the value of m/n is less than 0.5, the circularity of the toner deviates from that of a circle and the shape thereof is liable to be a distorted shape. Therefore, the development property and the transfer property may be decreased. Due to this, measures for increasing the circularity, for examples, changing the setting temperature for aggregation and fusion, or the like can be taken, however, even if the measures is taken, the circularity may not be sufficiently increased in some cases as compared with the case where the volume average particle diameter of the coloring agent is 3.5 μm or less, and the relation: $m/n \leqq 0.5$ is satisfied.

Incidentally, the lower limit of the volume average particle diameter of the coloring agent is not particularly limited, however, from the viewpoint of production, it can be set to, for example, 1.0 μm. Also, the lower limit of min is not particularly limited, however, from the viewpoint of production, it can be set to, for example, 0.1. Further, the toner according to this embodiment may be configured such that other components are contained or retained on the outer surface thereof as needed. Examples of the other components include a release agent, a charge control agent, an aggregating agent, a neutralizing agent, and an external additive.

The release agent is blended in the binder resin along with the coloring agent. Examples of the release agent include aliphatic hydrocarbon waxes such as low-molecular weight polyethylenes, low-molecular weight polypropylenes, polyolefin copolymers, polyolefin waxes, paraffin waxes, and Fischer-Tropsch waxes and modifications thereof; vegetable waxes such as candelilla wax, carnauba wax, Japan wax, jojoba wax, and rice wax; animal waxes such as bees wax, lanolin, and whale wax; mineral waxes such as montan wax, ozokerite, and ceresin; fatty acid amides such as linoleic acid amide, oleic acid amide, and lauric acid amide; and silicone-based waxes.

According to this embodiment, as the release agent, particularly, those having an ester bond of a component composed of an alcohol component and a carboxylic acid component are preferred. Examples of the alcohol component include higher alcohols, and examples of the carboxylic acid component include saturated fatty acids having a linear alkyl group, unsaturated fatty acids such as monoenic acid and polyenic acid, and hydroxy fatty acids. Further examples of the carboxylic acid component include unsaturated polyvalent carboxylic acids such as maleic acid, fumaric acid, citraconic acid, and itaconic acid. Further, anhydrides thereof may be used.

Among the above-mentioned carboxylic acid components, those having an unsaturated polyvalent carboxylic acid component and an anhydride thereof are particularly preferred.

From the viewpoint of low-temperature fixability, the softening point of the release agent is preferably from 60° C. to 120° C., more preferably from 70° C. to 110° C.

In the toner according to this embodiment, a charge control agent or the like for controlling a frictional charge amount may be blended. As the charge control agent, a metal-containing azo compound is used, and the metal element is preferably a complex or a complex salt of iron, cobalt, or chromium or a mixture thereof. Further, a metal-containing salicylic acid derivative compound is also used, and the metal element is preferably a complex or a complex salt of zirconium, zinc, chromium, or boron, or a mixture thereof.

According to this embodiment, in order to adjust the fluidity or chargeability of toner particles, inorganic fine particles may be externally added and mixed therewith in an amount of from 0.01 to 20% by mass based on the mass of the toner particles. As such inorganic fine particles, silica, titania, alumina, strontium titanate, tin oxide, and the like can be used alone or by mixing two or more of them. It is preferred that as the inorganic fine particles, those surface-treated with a hydrophobizing agent are used from the viewpoint of improvement of environmental stability. Further, other than such inorganic oxides, resin fine particles having a size of 1 μm or less may be externally added for improving the cleaning property.

Still further, according to this embodiment, the toner may be encapsulated using a shell material (such as a resin). In this case, it is preferred that an erasable color material component is not contained in the shell material. As a resin to be used as the shell material, other than the above-mentioned polyester resin, a resin obtained by copolymerization of an aromatic vinyl component and a (meth)acrylic acid ester component is preferred. Examples of the aromatic vinyl component include styrene, α-methylstyrene, o-methylstyrene, and p-chlorostyrene. Further, a sulfonic acid-based aromatic vinyl component such as sodium p-styrene sulfonate may be used. Examples of the acrylic acid ester component include ethyl acrylate, propyl acrylate, butyl acrylate, 2-ethylhexyl acrylate, butyl methacrylate, ethyl methacrylate, and methyl methacrylate. Among these, butyl acrylate is generally used. As the polymerization method, an emulsion polymerization method is generally employed, and the resin is obtained by radical polymerization of monomers of the respective components in an aqueous phase containing an emulsifying agent.

Alternatively, the above-mentioned polyester resin may be used as the shell material.

Other than these, a surfactant, a neutralizing agent, an aggregating agent, or the like may be used in the course of the production of the toner.

Examples of the surfactant include anionic surfactants such as sulfate ester salt-based, sulfonate-based, phosphate ester-based, and soap-based surfactants; cationic surfactants such as amine salt-based and quaternary ammonium salt-based surfactants; and nonionic surfactants such as polyethylene glycol-based, alkylphenol ethylene oxide adduct-based, and polyhydric alcohol-based surfactants.

Examples of the aggregating agent include metal salts such as sodium chloride, calcium chloride, calcium nitrate, barium chloride, magnesium chloride, zinc chloride, magnesium sulfate, aluminum chloride, aluminum sulfate, and potassium aluminum sulfate; inorganic metal salt polymers such as poly(aluminum chloride), poly(aluminum hydroxide), and calcium polysulfide; polymeric aggregating agents such as polymethacrylic esters, polyacrylic esters, polyacrylamides, and acrylamide sodium acrylate copolymers; coagulating agents such as polyamines, poly(diallyl ammonium halides), melanin formaldehyde condensates, and dicyandiamide; alcohols such as methanol, ethanol, 1-propanol, 2-propanol, 2-methyl-2-propanol, 2-methoxyethanol, 2-ethoxyethanol, and 2-butoxyethanol; organic solvents such as acetonitrile and 1,4-dioxane; inorganic acids such as hydrochloric acid and nitric acid; and organic acids such as formic acid and acetic acid.

As the neutralizing agent, an inorganic base or an amine compound can be used. Examples of the inorganic base include sodium hydroxide and potassium hydroxide. Examples of the amine compound include dimethylamine, trimethylamine, monoethylamine, diethylamine, triethylamine, propylamine, isopropylamine, dipropylamine, butylamine, isobutylamine, sec-butylamine, monoethanolamine, diethanolamine, triethanolamine, triisopropanolamine, isopropanolamine, dimethylethanolamine, diethylethanolamine, N-butyldiethanolamine, N,N-dimethyl-1,3-diaminopropane, and N,N-diethyl-1,3-diaminopropane.

Incidentally, in the toner according to this embodiment, the content ratios of the respective components can be appropriately determined by a person skilled in the art.

Subsequently, the method for producing a toner according to this embodiment will be described. The method for producing a toner according to this embodiment is not particularly limited. For example, the toner can be produced by aggregating and fusing an encapsulated coloring agent and particles of a binder resin.

Examples of a method for forming the encapsulated coloring agent include an interfacial polymerization method, a coacervation method, an in situ polymerization method, a submerged drying method, and a submerged curing coating method.

Further, a method for preparing the particles containing the binder resin is not particularly limited. For example, the particles can be prepared using a melt-kneading method or an emulsion polymerization method. The size of the prepared fine particles containing the binder resin is not particularly limited.

For example, a composition containing a binder resin and a release agent is homogenously mixed using a dry mixer, and the resulting mixture is melt-kneaded using a twin-screw kneader. Then, the melt-kneaded composition is pulverized using a pin mill. The pulverized material is dispersed in pure water along with a surfactant and a neutralizing agent. Subsequently, the dispersion liquid is processed using a high-pressure homogenizer, whereby a dispersion liquid of particles containing the binder resin having a size of, for example, about 200 nm is obtained.

Subsequently, the thus prepared encapsulated coloring agent and particles containing the binder resin are aggregated. Specifically, to a dispersion liquid in which the coloring agent and the particles containing the binder resin are dispersed in a dispersion medium, for example, an aqueous dispersion medium such as water, an aggregating agent is added, followed by heating, whereby the coloring agent and the particles containing the binder resin are aggregated. The type and addition amount of the aggregating agent and the heating temperature can be appropriately determined by a person skilled in the art.

Subsequently, the fluidity of the binder resin is increased by heating, and the aggregated coloring agent and the particles containing the binder resin are fused. The heating temperature in this fusion treatment can also be appropriately determined by a person skilled in the art.

More specifically, the aggregation and fusion treatments can be performed, for example, as follows. A dispersion liquid of the encapsulated coloring agent and a dispersion liquid of the particles containing the binder resin are mixed, and aluminum sulfate serving as an aggregating agent is added thereto while stirring at 40° C., whereby the coloring agent and the particles containing the binder resin are aggregated. Then, the temperature of the mixture is gradually raised while stirring and maintained at 80° C., whereby the coloring agent and the particles containing the binder resin are fused.

Subsequently, the particles obtained by the fusion treatment are washed and dried, whereby a toner is produced. To the produced toner, an external additive such as silica or titanium oxide is externally added as needed.

An apparatus for performing washing according to this embodiment is not particularly limited, however, for example, a centrifugal separator, a filter press, or the like is preferably used. In the washing treatment, as a washing liquid, for example, water, ion exchanged water, purified water, water adjusted to an acidic pH, water adjusted to a basic pH, or the like is used, and washing and filtration are repeated, whereby a water-containing cake is obtained. The water-containing cake is dried to a water content of about 1% by mass using a given drying method such as a flash dryer, a vibration dryer, or an oven. The dried material is crushed by a given method.

Incidentally, the volume average particle diameter, the number-based particle size distribution CV, and the average circularity of the toner can be adjusted by the aggregating temperature, fusing temperature, the amount of the aggregating agent, and the stirring rotation speed.

For example, by raising the aggregating temperature or increasing the amount of the aggregating agent, the particle diameter of the toner can be increased.

Further, the volume average particle diameter of the coloring agent can be also adjusted by, for example, the temperature at the time of preparation or the production condition at the time of encapsulation such as the amount of a material to be used such as a shell material.

The toner according to this embodiment is mixed with a carrier in the same manner as a common toner and is prepared as a developer. The thus prepared developer is placed in, for example, an image forming apparatus such as a multifunction peripheral (MFP) and is used for forming an image on a paper medium.

In the image formation step, as a result of heating a toner image formed using the toner according to this embodiment and transferred onto a paper medium at a fixing temperature, the resin is melted and penetrates into the paper medium, and thereafter, the resin is solidified, thereby forming an image on the paper medium (fixing treatment).

Further, the image formed on the paper medium can be erased by performing a decolorizing treatment for the toner. Specifically, the decolorizing treatment can be performed by heating the paper medium having the image formed thereon at a heating temperature not lower than the decolorization initiation temperature so as to dissociate the bound color former compound and the color developing agent from each other.

Hereinafter, the case where an image is formed in an image forming apparatus using the toner according to this embodiment will be described.

Incidentally, the paper medium on which an image is formed using the toner according to this embodiment may be newly used paper or a reused paper medium on which an image was formed using a decolorable toner and thereafter the image was erased by a decolorizing operation. In the case of using the reused paper medium, the toner used when the image was formed in the past may be the decolorable toner according to this embodiment or may be a decolorable toner different from the toner according to this embodiment. Even if an image is formed on the reused paper medium, by using the toner according to this embodiment, the stability in the transferring step can be improved, and therefore, the occurrence of unevenness in an image or the like can be prevented.

Figure 2:
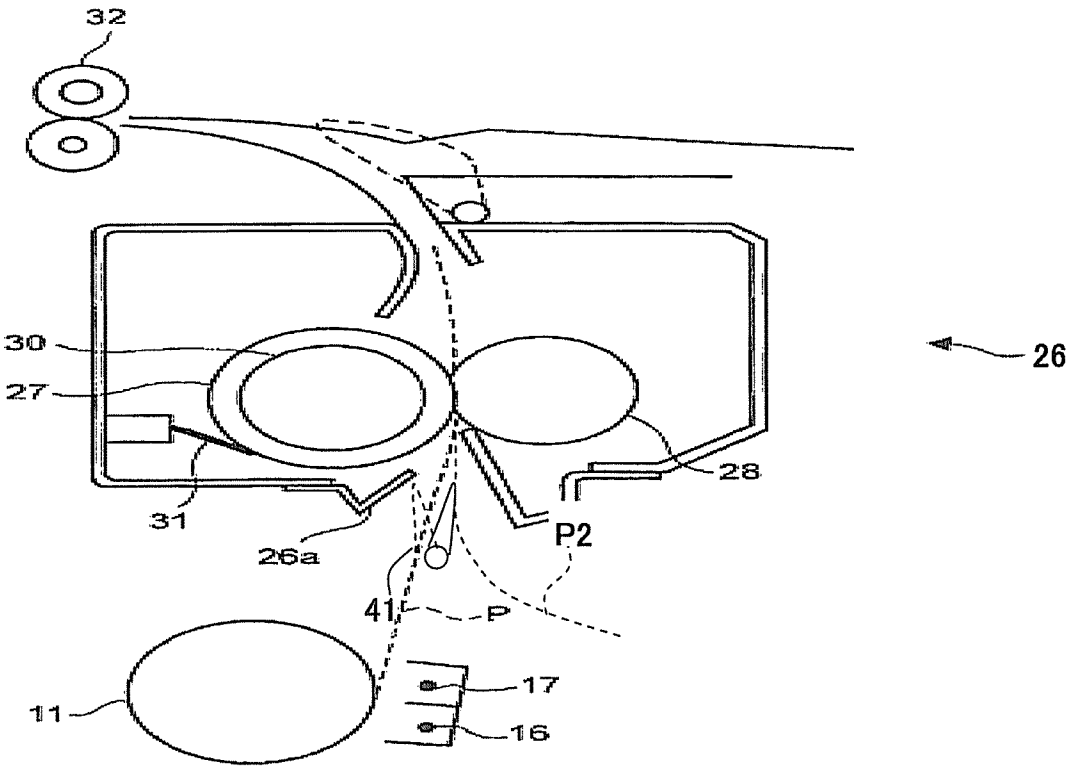
FIG. 2 is a schematic view showing a fixing device of an image forming apparatus in which a developer containing a toner according to an embodiment is placed.

FIG. 1 is a schematic structural view showing an image forming section 10 of a copier or the like serving as an image forming apparatus. FIG. 2 is a schematic structural view showing a fixing device 26 in an image forming apparatus.

A photoconductive drum 11 (electrostatic latent image carrying member) of the image forming section 10 has an organic photoconductor (OPC) on the surface of a support member (ϕ60 mm), and is driven in the direction of the arrow s at a predetermined paper conveying speed (for example, at a peripheral speed of 100 mm/sec). Around the photoconductive drum 11, an electric charger 12 that uniformly charges the photoconductive drum 11 at −750 V sequentially according to the rotation of the photoconductive drum 11, a laser exposure device 13 (electrostatic latent image forming section) that irradiates laser light based on the information of an image onto the charged photoconductive drum 11, a developing device 14 (developing section), a transfer charger 16 (transferring section), a detachment charger 17, a cleaner 18 having a cleaning blade 18*a*, and a charge elimination LED 19 are arranged.

At the position of the transfer charger 16 of the image forming section 10, paper P that is a recording medium is taken out from a paper feed cassette device 20 by a paper feed roller 21 and is conveyed in synchronization with a toner image on the photoconductive drum 11 by a resist roller 22.

The developing device 14 uses, for example, a two-component developer which is a mixture of the toner according to this embodiment and a magnetic carrier having a volume average particle diameter of from 30 to 80 μm as the developer.

To a developing roller 14*a* of the developing device 14, a development bias of about −550 V is applied, and a toner image is formed on the electrostatic latent image on the photoconductive drum 11 by reversal development.

The transfer charger 16 transfers the formed toner image on the conveyed paper P and forms a transferred image.

On the upper part of the image forming section 10, a fixing device 26 (fixing section) that fixes the toner image by heating and pressing the paper P on which the unfixed toner image is formed using the toner according to this embodiment by the image forming section 10 is provided. The fixing device 26 has a fixing roller 27 that is a fixing rotating body, and a pressing roller 28 that is a pressing rotating body and is in press-contact with the fixing roller 27. The fixing roller 27 and the pressing roller 28 rotate at a predetermined paper conveying speed (for example, a peripheral speed of 100 mm/sec). Further, the fixing device 26 has an inlet guide 26*a* for guiding the paper P into a nip between the fixing roller 27 and the pressing roller 28. At the downstream side in the conveying direction of the paper P of the fixing device 26, a paper discharge roller 32 for discharging the paper P after fixing in a predetermined direction is provided.

Subsequently, a process of forming an image on the paper P will be described. When an image forming process starts, in the image forming section 10, the photoconductive drum 11 rotating in the direction of the arrow s is charged to −750 V uniformly by the electric charger 12, laser light is irradiated based on the original document information by the laser exposure device 13, whereby an electrostatic latent image is formed. Then, this electrostatic latent image is developed using the toner according to this embodiment by the developing device 14, and a toner image comprising the toner according to this embodiment is formed on the photoconductive drum 11.

For example, the predetermined paper P supplied from the paper feed cassette device 20 is conveyed at the position of the transfer charger 16 in synchronization with the toner image on the photoconductive drum 11 by the resist roller 22, and the toner image on the photoconductive drum 11 is transferred on the paper P.

Then, the paper P is detached from the photoconductive drum 11 and is allowed to pass between the fixing roller 27 and the pressing roller 28 of the fixing device 26 to heat and press the paper P having the toner image formed thereon, whereby the toner image is fixed. In the fixing device 26, after completion of fixation of the toner image formed using the decolorable toner, the paper P is discharged in a predetermined direction by the paper discharge roller 32. After completion of the transfer, the photoconductive drum 11 is cleaned by removing the residual toner by the cleaner 18, the remaining charge is removed by the charge eliminating LED 19, and the image forming process is terminated.

On the paper P on which the toner image based on the information of the image is formed using the decolorable toner in this manner, the toner image is erased for reuse by decolorizing the toner after use (decolorizing operation). The toner image can be erased by setting the temperature of a fixing device in an image forming apparatus to a temperature at which the toner is decolorized (for example, 100 to 140° C.), and conveying paper in the image forming apparatus such that an image is not formed, whereby the image can be erased by the heat of the fixing device instantaneously (for example, within one second).

Hereinafter, the toner according to this embodiment will be described in more detail by showing Examples, however, the invention is by no means limited to these Examples.

EXAMPLE 1

Production of Dispersion Liquid of Particles Containing Binder Resin 39 parts by mass of terephthalic acid, 61 parts by mass of an ethylene oxide compound of bisphenol A, and 0.2 parts by mass of dibutyltin were placed into an esterification reaction vessel and the resulting mixture was subjected to a polycondensation reaction at 260° C. and 50 kPa for 5 hours under a nitrogen atmosphere, whereby a polyester resin was obtained. The polyester resin had a glass transition temperature Tg of 60° C., a softening point of 110° C., and a weight average molecular weight of 12000. This polyester resin was pulverized and a dispersion liquid (emulsion liquid) of particles containing a binder resin was prepared using a high-pressure homogenizer.

Production of Styrene-acrylic Resin for Encapsulation of Toner 90 parts by mass of styrene, 10 parts by mass of n-butyl acrylate, 100 ppm of sodium p-styrene sulfonate, 1.5 parts by mass of tertiary dodecyl mercaptan as a chain transfer agent, and 0.5 parts by mass of LATEMUL PS manufactured by Kao Corporation as an emulsifying agent were added, and then, 0.8 parts by mass of ammonium persulfate as a polymerization initiator was added to effect emulsion polymerization at 60° C., whereby an emulsion liquid of a styrene-acrylic resin was obtained. The styrene-acrylic resin had a glass transition temperature of 80° C. and a weight average molecular weight of 25000.

Preparation of Coloring Agent

Crystal violet lactone (CVL) as a leuco dye, benzyl 4-hydroxybenzoate as a color developing agent, and 4-benzyloxyphenylethyl laurate as a temperature control agent were melted by heating at 200° C. Then, the resulting material was encapsulated by a known coacervation method using a urethane resin as a shell material.

Aggregation and Fusion Step 10 parts by mass of the encapsulated coloring agent, 85 parts by mass of the dispersion liquid of particles containing a binder resin, and 5 parts by mass of a dispersion liquid of a release agent (rice wax) were aggregated at 50° C. using 3.0% by mass of aluminum sulfate [$Al_2(SO_4)_3$]. Then, 20 parts by mass of the emulsion liquid of a styrene-acrylic resin was added thereto to encapsulate a toner. Thereafter, the temperature of the mixture was raised to 75° C. at a temperature raising rate of 5° C./30 min to effect fusion, followed by washing and drying, whereby a toner having a volume average particle diameter of 10.3 μm, a particle size distribution CV of 27%, and an average circularity of 0.942 was obtained.

EXAMPLE 2

A toner having a volume average particle diameter of 7.5 μm, a particle size distribution CV of 31%, and an average circularity of 0.954 was obtained in the same manner as in Example 1 except that the addition amount of aluminum sulfate was changed to 2.5 parts by mass.

EXAMPLE 3

A toner having a volume average particle diameter of 11.4 μm, a particle size distribution CV of 31%, and an average circularity of 0.970 was obtained in the same manner as in Example 1 except that the addition amount of aluminum sulfate was changed to 3.3 parts by mass.

EXAMPLE 4

A toner having a volume average particle diameter of 5.0 μm, a particle size distribution CV of 32%, and an average circularity of 0.921 was obtained in the same manner as in Example 1 except that the addition amount of aluminum sulfate was changed to 2.5 parts by mass, and the aggregating temperature was changed to 45° C.

EXAMPLE 5

A toner having a volume average particle diameter of 15.0 μm, a particle size distribution CV of 34%, and an average circularity of 0.950 was obtained in the same manner as in Example 1 except that the addition amount of aluminum sulfate was changed to 4.0 parts by mass.

EXAMPLE 6

A toner having a volume average particle diameter of 8.3 μm, a particle size distribution CV of 35%, and an average circularity of 0.963 was obtained in the same manner as in Example 1 except that the addition amount of aluminum sulfate was changed to 2.8 parts by mass.

EXAMPLE 7

A toner having a volume average particle diameter of 9.5 μm, a particle size distribution CV of 35%, and an average circularity of 0.985 was obtained in the same manner as in Example 1 except that the fusing temperature was changed to 78° C.

EXAMPLE 8

A toner having a volume average particle diameter of 9.8 μm, a particle size distribution CV of 32%, and an average circularity of 0.931 was obtained in the same manner as in Example 1 except that the fusing temperature was changed to 72° C.

Comparative Example 1

A toner having a volume average particle diameter of 4.5 μm, a particle size distribution CV of 30%, and an average circularity of 0.87 was obtained in the same manner as in Example 1 except that the addition amount of aluminum sulfate was changed to 2.0 parts by mass.

Comparative Example 2

A toner having a volume average particle diameter of 16.2 μm, a particle size distribution CV of 25%, and an average circularity of 0.93 was obtained in the same manner as in Example 1 except that the addition amount of aluminum sulfate was changed to 3.8 parts by mass.

Comparative Example 3

A toner having a volume average particle diameter of 10.5 μm, a particle size distribution CV of 45%, and an average circularity of 0.870 was obtained in the same manner as in Example 1 except that the temperature raising rate at the time of aggregation and fusion was changed to 5° C./15 min.

Incidentally, the volume average particle diameter and the number average particle diameter of each of the toners of the respective Examples and Comparative examples were measured using a particle diameter measuring device (Multisizer 3, manufactured by Beckman Coulter, Inc., aperture diameter: 100 μm, the measurement was performed for 50000 particles).

The particle size distribution CV was calculated based on the measured number average particle diameter and a standard deviation thereof.

Further, the average circularity was determined as follows. To 0.05 g of a toner sample, 30 ml of pure water and 2 ml of an anionic soap were added, and the resulting mixture was dispersed for 5 minutes using an ultrasonic disperser to prepare a sample. The resulting sample was subjected to the measurement using a flow-type particle image analyzer (FPIA-2100, manufactured by Sysmex Corporation) and for particles having a circle-corresponding diameter of from 0.60 to 400 μm, the particle diameter of the circle-corresponding diameter was measured. Then, the circularity of the particle measured was calculated. Further, for the particles having a circle-corresponding diameter of from 0.60 to 400 μm, the sum of the circularities was divided by the total number of the particles, and the obtained value was defined as the average circularity. The measurement was performed for 3000 particles.

Preparation of Developer

Each of the obtained toners of Examples and Comparative examples was mixed with a ferrite carrier coated with a silicone resin or the like, whereby a developer was prepared.

Image Formation

In an MFP (e-studio 4520c) manufactured by Toshiba Tec Corporation, the temperature of a fixing device was set to 85° C. and the paper feed speed was set to 40 mm/sec, and an image was formed on PPC paper (P-50S) manufactured by Toshiba Corporation.

Decolorizing Operation

In a decolorizing operation for an image, e-studio 4520c was used as a decolorizing device by setting the temperature of a fixing device to 120° C. The image was erased by conveying a paper at a paper feed speed of 40 mm/sec in the e-studio 4520c.

Measurement of Image Density

An image density was measured using a reflectometer (RD-19I) manufactured by GretagMacbeth Co., Ltd. In the measurement, a solid chart in which fifteen 1.0 cm×1.0 cm square solid patches were arranged perpendicular to the conveying direction and twenty 1.0 cm×1.0 cm square solid patches were arranged parallel to the conveying direction was used. The measurement was performed for 300 square solid patches using the reflectometer, and an average of the measurements was defined as the image density.

Incidentally, from the standpoint that the image after decolorization is not recognized, the image density after the decolorizing operation is preferably 0.15 or less, more preferably 0.10 or less.

Charging Stability 15000 sheets of paper were fed through the apparatus under NN condition of normal temperature and normal humidity (20° C., 50%), under HH condition of high temperature and high humidity (30° C., 85%), and under LL condition of low temperature and low humidity (10° C., 20%), respectively, and evaluation was performed.

The charging stability was evaluated as follows. The charge amount under the respective conditions was measured using a suction blow-off device (TB-203, manufactured by Kyocera Chemical Corporation), and the ratio e of the charge amount eH under the HH condition to the charge amount eL under the LL condition (e=(eH/eL)×100(%)) was calculated. The case where e was as follows: e≦50% was evaluated as "AA", the case where e was as follows: 40%≦e≦50% was evaluated as "A", the case where e was as follows: 30%≦e≦40% was evaluated as "B", and the case where e was as follows: e≦30% was evaluated as "C".

Toner Scattering

The toner scattering was evaluated as follows. After paper feeding was performed under three environments of NN condition, HH condition and LL condition, the toner adhering to the developing device was recovered by suction, whereby the amount of the scattered toner was obtained. The case where the amount of the scattered toner was 25 mg or less was evaluated as "AA", the case where the amount of the scattered toner was 25 mg or more and 75 mg or less was evaluated as "A", the case where the amount of the scattered toner was 75 mg or more and 125 mg or less was evaluated as "B", and the case where the amount of the scattered toner was 125 mg or more was evaluated as "C".

Transfer Property

The transfer property was evaluated by observing the 5th printed data after printing was performed 4 times using the toner and the print was erased 4 times.

As for the transfer property, in the case of developing only one color, the case where the transfer efficiency d was as follows: 90%≦d was evaluated as "AA", the case where d was as follows: 87%≦d≦90% was evaluated as "A", the case where d was as follows: 84%≦d≦87% was evaluated as "B", and the case where d was as follows: d≦84% was evaluated as "C". Incidentally, as a calculation formula for obtaining the transfer efficiency, by considering the respective transfer efficiencies for the primary transfer from a photoconductive drum to a transfer belt, the secondary transfer from the transfer belt to a paper sheet, and the reverse transfer which is the transfer from the transfer belt to the photoconductive drum on a subsequent stage, the following formula was used.

$$\text{Transfer efficiency}=(\alpha-\beta-\gamma-\Delta)/\alpha$$

α: weight of toner per unit area on paper ($mg/cm^2$)

β: weight of residual toner per unit area on photoconductive drum ($mg/cm^2$)

γ: weight of residual toner per unit area on secondary transfer belt ($mg/cm^2$)

Δ: weight of residual toner per unit area on photoconductive drum on subsequent stage ($mg/cm^2$)

While certain embodiments have been described, these embodiments have been presented by way of example only, and are not intended to limit the scope of invention. Indeed, the novel method described herein may be embodied in a variety of other forms; furthermore, various omissions, substitutions and changes in the form of the toner, apparatus and method described herein may be made without departing from the sprit of the inventions. The accompanying claims and their equivalents are intended to cover such forms or modifications as would fall within the scope and spirit of the inventions.

As described in detail in the above, according to the technique described herein, a decolorable toner in which the color developing property can be improved, and has excellent stability in a transferring step even if an image is formed on a reused paper medium can be provided.

What is claimed is:

1. A decolorable toner, comprising a binder resin and a coloring agent which contains a color former compound and a color developing agent being present in a temperature control agent and has a capsule structure such that it is covered with an outer shell, and having a volume average particle diameter of from 5.0 to 15.0 μm, and a particle size distribution CV of 35% or less.

2. The toner according to claim 1, wherein the toner has a volume average particle diameter of from 7.5 to 13.0 μm.

3. The toner according to claim 1, wherein the toner has an average circularity of from 0.925 to 0.970.

4. The toner according to claim 1, wherein the coloring agent has a volume average particle diameter of 3.5 pm or less, and the toner satisfies the relation: m/n≦0.5, wherein m represents the volume average particle diameter of the coloring agent and n represents the volume average particle diameter of the toner.

5. An image forming apparatus, comprising:

an electrostatic latent image forming section that forms an electrostatic latent image on an electrostatic latent image carrying member;

a developing section that forms a visible image by developing the electrostatic latent image formed by the electrostatic latent image forming section using a decolorable toner containing a binder resin and a coloring agent which contains a color former compound and a color developing agent being present in a temperature control agent and has a capsule structure such that it is covered with an outer shell, and having a volume average particle diameter of from 5.0 to 15.0 μm and a particle size distribution CV of 35% or less;

a transferring section that forms a transferred image by transferring the visible image formed by the developing section to a recording medium; and a fixing section that fixes the transferred image formed by the transferring section on the recording medium.

6. The apparatus according to claim 5, wherein the decolorable toner has a volume average particle diameter of from 7.5 to 13.0 μm.

7. The apparatus according to claim 5, wherein the decolorable toner has an average circularity of from 0.925 to 0.970.

8. The apparatus according to claim 5, wherein the coloring agent has a volume average particle diameter of 3.5 μm or less, and the toner satisfies the relation: m/n≦0.5, wherein m represents the volume average particle diameter of the coloring agent and n represents the volume average particle diameter of the toner.

9. A method for forming an image, comprising:

forming an electrostatic latent image on an electrostatic latent image carrying member;

forming a visible image by developing the formed electrostatic latent image using a decolorable toner containing a binder resin and a coloring agent which contains a color former compound and a color developing agent being present in a temperature control agent and has a capsule structure such that it is covered with an outer shell, and having a volume average particle diameter of from 5.0 to 15.0 μm and a particle size distribution cv of 35% or less;

forming a transferred image by transferring the formed visible image to a recording medium; and fixing the formed transferred image on the recording medium.

10. The method according to claim 9, wherein the decolorable toner has a volume average particle diameter of from 7.5 to 13.0 μm.

11. The method according to claim 9, wherein the decolorable toner has an average circularity of from 0.925 to 0.970.

12. The method according to claim 9, wherein the coloring agent has a volume average particle diameter of 3.5 μm or less, and the toner satisfies the relation: m/n≦0.5, wherein m represents the volume average particle diameter of the coloring agent and n represents the volume average particle diameter of the toner.

* * * * *